US012022983B2

(12) United States Patent
Yassa

(10) Patent No.: US 12,022,983 B2
(45) Date of Patent: Jul. 2, 2024

(54) BATHING STAND FOR CHILDREN

(71) Applicant: Meray Yassa, Kellyville (AU)

(72) Inventor: Meray Yassa, Kellyville (AU)

(73) Assignee: Charlichair Holdings Pty Ltd., Bella Vista (AU)

( * ) Notice: Subject to any disclaimer, the term of this patent is extended or adjusted under 35 U.S.C. 154(b) by 0 days.

(21) Appl. No.: 14/738,755

(22) Filed: Jun. 12, 2015

(65) Prior Publication Data

US 2016/0331189 A1 Nov. 17, 2016
US 2017/0099999 A9 Apr. 13, 2017

Related U.S. Application Data

(63) Continuation-in-part of application No. 14/442,086, filed as application No. PCT/AU2013/001297 on Nov. 8, 2013, now abandoned.

(30) Foreign Application Priority Data

Nov. 8, 2012 (AU) ..... 2012904879

(51) Int. Cl.
*A47K 3/28* (2006.01)
*A47C 7/56* (2006.01)
(Continued)

(52) U.S. Cl.
CPC ..... *A47K 3/282* (2013.01); *A47C 7/563* (2013.01); *A47C 7/60* (2013.01); *A47D 1/002* (2013.01);
(Continued)

(58) Field of Classification Search
CPC ..... A47K 3/024; A47K 3/122; A47K 3/127; A47K 3/282; A47D 1/002; A47C 7/60; A47C 7/563
(Continued)

(56) References Cited

U.S. PATENT DOCUMENTS 2,460,308 A * 2/1949 Pribil ..... A47K 3/127 5/655
3,290,090 A 12/1966 Ford
(Continued)

FOREIGN PATENT DOCUMENTS

AU 2015203021 C1 4/2017
CN 201585730 U 9/2010
(Continued)

OTHER PUBLICATIONS

International Search Report mailed Jan. 13, 2014 for International Application No. PCT/AU2013/001297.
(Continued)

*Primary Examiner* — David P Angwin
*Assistant Examiner* — William R Klotz
(74) *Attorney, Agent, or Firm* — Kevin Keener; Keener and Associates P.C.

(57) ABSTRACT

A child bathing stand or chair for supporting a child, particularly an infant or baby, and for use during bathing. The bathing stand or chair having a pedestal for supporting in an elevated position the seat which supports the child's body. The seat includes a shell that forms a hollow pod having sides that act as guards , a seat base and a seatback and the seat base has lateral sides and a centrally disposed substantially planar middle section having a plurality of apertures arranged to allow water to channel and drain from the seat base during use.

5 Claims, 15 Drawing Sheets

(51) Int. Cl.

| | |
|---|---|
| ***A47C 7/60*** | (2006.01) |
| ***A47D 1/00*** | (2006.01) |
| ***A47D 11/00*** | (2006.01) |
| ***A47K 3/12*** | (2006.01) |

(52) U.S. Cl.
CPC ..... *A47D 1/004* (2013.01); *A47D 11/00* (2013.01); *A47K 3/122* (2013.01); *A47K 3/127* (2013.01)

(58) Field of Classification Search
USPC ..... 4/572.1, 578.1, 611; 297/250.1, 325–328
See application file for complete search history.

(56) References Cited

U.S. PATENT DOCUMENTS

| | | | | | |
|---|---|---|---|---|---|
| 3,492,047 | A * | 1/1970 | Dudouyt | A47D 1/002 | 297/377 |
| 3,900,902 | A * | 8/1975 | Jarosinski | A47K 4/00 | 4/554 |
| 3,924,278 | A * | 12/1975 | Ekman | A47K 3/007 | 4/540 |
| 4,160,292 | A * | 7/1979 | Kuether | A47K 3/022 | 4/590 |
| 4,359,045 | A * | 11/1982 | Cozzi | A47D 15/006 | 601/24 |
| 4,809,368 | A * | 3/1989 | Johansson | A47K 3/007 | 4/540 |
| 5,028,061 | A * | 7/1991 | Hawkes | B62B 7/04 | 280/47.4 |
| 5,364,137 | A * | 11/1994 | Shimer | A47D 15/006 | 297/130 |
| 5,375,869 | A * | 12/1994 | Hsiao | A47D 1/02 | 280/31 |
| 5,393,119 | A * | 2/1995 | Mukai | A47K 3/007 | 297/217.1 |
| 5,588,159 | A * | 12/1996 | Poulson | A47K 3/024 | 4/523 |
| D404,805 | S * | 1/1999 | Hurt | D23/280.2 | |
| D419,225 | S * | 1/2000 | Johansson | D23/280.2 | |
| 6,243,890 | B1 * | 6/2001 | Yang | A47K 3/024 | 4/572.1 |
| D454,007 | S | 3/2002 | Huang | | |
| 6,398,304 | B1 | 6/2002 | Chen | | |
| 6,785,917 | B1 * | 9/2004 | Bryant | A47K 3/024 | 4/572.1 |
| 7,533,425 | B2 * | 5/2009 | Monti | A47K 3/024 | 4/572.1 |
| 7,832,801 | B2 * | 11/2010 | Driessen | A47D 1/004 | 297/153 |
| 8,550,556 | B2 * | 10/2013 | Asbach | A47D 1/002 | 297/273 |
| 8,973,997 | B2 | 3/2015 | Green | | |
| 2006/0181123 | A1 * | 8/2006 | Gibree | A47D 1/08 | 297/250.1 |
| 2009/0193576 | A1 | 8/2009 | Hsiao | | |
| 2011/0061159 | A1 | 3/2011 | Mardirossian | | |
| 2011/0083261 | A1 * | 4/2011 | Goergen | A47K 3/127 | 4/572.1 |
| 2012/0061999 | A1 | 3/2012 | Soriano | | |
| 2012/0233767 | A1 | 9/2012 | Liu | | |
| 2015/0313418 | A1 | 11/2015 | Yassa | | |
| 2020/0352396 | A1 * | 11/2020 | Osmond | A47C 7/22 | |

FOREIGN PATENT DOCUMENTS

| | | | | |
|---|---|---|---|---|
| GB | 2155323 | A | 9/1985 | |
| GB | 2213712 | A * | 8/1989 | A47D 1/002 |
| GB | 2386321 | A | 9/2003 | |
| GB | 2478705 | A | 9/2011 | |
| JP | 2009-247412 | | 10/2009 | |

OTHER PUBLICATIONS

PCT Written Opinion for PCT/AU2013/001297 mailed Jan. 13, 2014 for International Application No. PCT/AU2013/001297.
International Preliminary Report on Patentability issued on May 12, 2015 for International Application No. PCT/AU2013/001297.
U.S. Appl. No. 14/442,086, filed May 11, 2015.
From U.S. Appl. No. 14/442,086 (now published as US 2015/0313418), Office Action mailed on Oct. 6, 2016.
Office Action from Australian Patent Application No. 2015203021 dated Mar. 23, 2016.
Office Action from Australian Patent Application No. 2015203021 dated Mar. 17, 2017.
Notice of Allowance from Australian Patent Application No. 2015203021 dated Apr. 4, 2017.

* cited by examiner

BATHING STAND FOR CHILDREN

CROSS-REFERENCE TO RELATED APPLICATIONS

This application is a continuation-in-part of U.S. patent application Ser. No. 14/442,086, filed on May 11, 2015, which is the U.S. National Stage of International Patent Application No. PCT/AU2013/001297 filed on Nov. 8, 2013, which claims priority to Australian Patent Application No. 2012904879, filed on Nov. 8, 2011, to which the priorities of and the benefits of are hereby claimed and which are incorporated herein in their entireties by reference.

FIELD OF THE INVENTION

This invention relates to a bathing stand for children in particular for showering of infants or toddlers.

Whilst the invention has been developed primarily for use in the showering of infants or toddlers and will be described hereinafter with regard to that application, it will be appreciated that the invention is not limited to this particular use. For example the invention may have utility for bathing pets or temporarily holding and restraining infants or toddlers in situ without bathing or showering in mind, whilst some other activity is undertaken by a parent or carer.

Throughout the specification, unless the context requires otherwise, the word "comprise" or variations such as "comprises" or "comprising", will be understood to imply the inclusion of a stated integer or group of integers but not the exclusion of any other integer or group of integers.

BACKGROUND ART

The following discussion of the background art is intended to facilitate an understanding of the present invention only. It should be appreciated that the discussion is not an acknowledgement or admission that any of the material referred to was part of the common general knowledge as at the priority date of the application.

One of the difficult tasks for parents and carers is bathing or showering infants and young children. There are many inherent risks and difficulties in this task for both the child and the adult, including slipping and falling, water danger, and an occupational health and safety issue with an adult or carer having to bend down constantly and handle a moving slippery child.

DISCLOSURE OF THE INVENTION

The present invention seeks to overcome or substantially ameliorate at least some of the deficiencies of the prior art, or to at least provide an alternative to same.

In accordance with a first aspect of the present invention, there is provided a stand for supporting an object, the stand including:

a seat to support the torso of the object;

a pedestal upon which the seat is mounted in an elevated position; and adjustment means to facilitate selected rotation and locking of the seat relative to the pedestal;

wherein the seat comprises a capsule having sides, a seat base and a seatback to encapsulate the torso of the object;

and wherein the adjustment means comprises rotation limiting means to restrict rotation of the seat relative to the stand between a prescribed range of angular movement.

Preferably, the adjustment means comprises a number of components fitted together to selectively support and angularly locate the seat relative to the pedestal, these components including:

a pair of seat recesses that are moulded one into each of the outer sides of the seat;

a pair of stand seat supports, one fitted respectively to the seat connecting ends of upper seat attachment portions provided on the pedestal;

a pair of adjustment latches, each fitted into a corresponding stand seat support and secured to the corresponding seat recess; and a pair of locking spindles, each screwed into a corresponding threaded sleeve provided in each stand seat support.

Preferably, each seat recess is formed with a plurality of threaded spigots, equidistantly disposed to align with corresponding recesses integrally formed within each of the adjustment latches to be fixedly connected to the corresponding seat recesses.

Preferably, the stand seat supports are each formed with transversely extending slots that are equidistantly disposed to align with and accommodate the corresponding threaded spigots 99 therein and form the rotation limiting means.

Preferably, the range of movement is limited to approximately 15°, whereby at one extreme the seat is positioned at a maximally reclined attitude of approximately 30° relative to the horizontal, and at another extreme the seat is positioned at its most vertical attitude relative to the pedestal, being at an angle of approximately 45° to the horizontal.

Preferably, the stand seat supports each comprise a central circular upstanding boss having a knurled outer surface and centrally within each is disposed the corresponding threaded sleeve.

Preferably, the adjustment latches are of complementary circular shape to the inner recesses provided by the stand seat supports and have a complementary shaped circular recess on the inner side to receive and accommodate relative rotation of the corresponding circular upstanding boss therein.

Preferably, the outer side of each adjustment latch correspondingly forms an outward extending boss having a central aperture to align with the threaded sleeve of the corresponding stand seat support.

Preferably, the locking spindles each have a threaded shaft that can be disposed within the aperture of the corresponding adjustment latch and which are of a diameter to threadedly engage the threaded sleeve formed within the upstanding boss of each stand seat support, and wherein by consequential rotation of each locking spindle, the inner surface presses upon the outer surface of the corresponding adjustment latch and clamps it to the inner recess provided by the corresponding stand seat support, resulting in the knurled outer surface of the circular upstanding boss thereof frictionally engaging the confronting inner surface of the complementary shaped circular recess of the adjustment latch and locking the angular position of the corresponding seat recess relative to the corresponding stand seat support.

Preferably, the rear of the seat is particularly formed to positively receive and fix into position a bath shell accessory, the bath shell accessory being shaped to closely fit the rear surface of the seat and be fixed into position relative thereto.

Preferably, the bath shell accessory forms a V-shaped trough so that when the seat s disposed in the maximally reclined position a well is provided within which water may pool at the juncture between the seat base and the seatback of the seat.

BRIEF DESCRIPTION OF THE DRAWINGS

The invention will be better understood in the light of the following description of the best mode for carrying out the invention, which is made with reference to the following drawings, wherein:

FIG. 4 (*b*) is a front perspective view of the stand shown in FIG. 4 (*a*);

FIGS. 15A to 15E are a series of views showing how the adjustment means mechanism is assembled in accordance with the third embodiment, wherein:

FIG. 15A is a fragmentary perspective view of the moulded seat recess;

FIG. 15B is a perspective view of the stand seat support fitted into the moulded seat recess of FIG. 15A;

FIG. 15C is a perspective view of the adjustment latch fitted into the stand seat support and in the process of secured to the seat recess;

FIG. 15D is a perspective view of the adjustment latch showing it in isolation from the other components and secured into position with latching screws to the seat recess;

FIG. 15E is a fragmentary perspective view showing the complete adjustment means mechanism with the locking spindle screwed into position to lock the mechanism;

BEST MODE(S) FOR CARRYING OUT THE INVENTION

Figure 1:
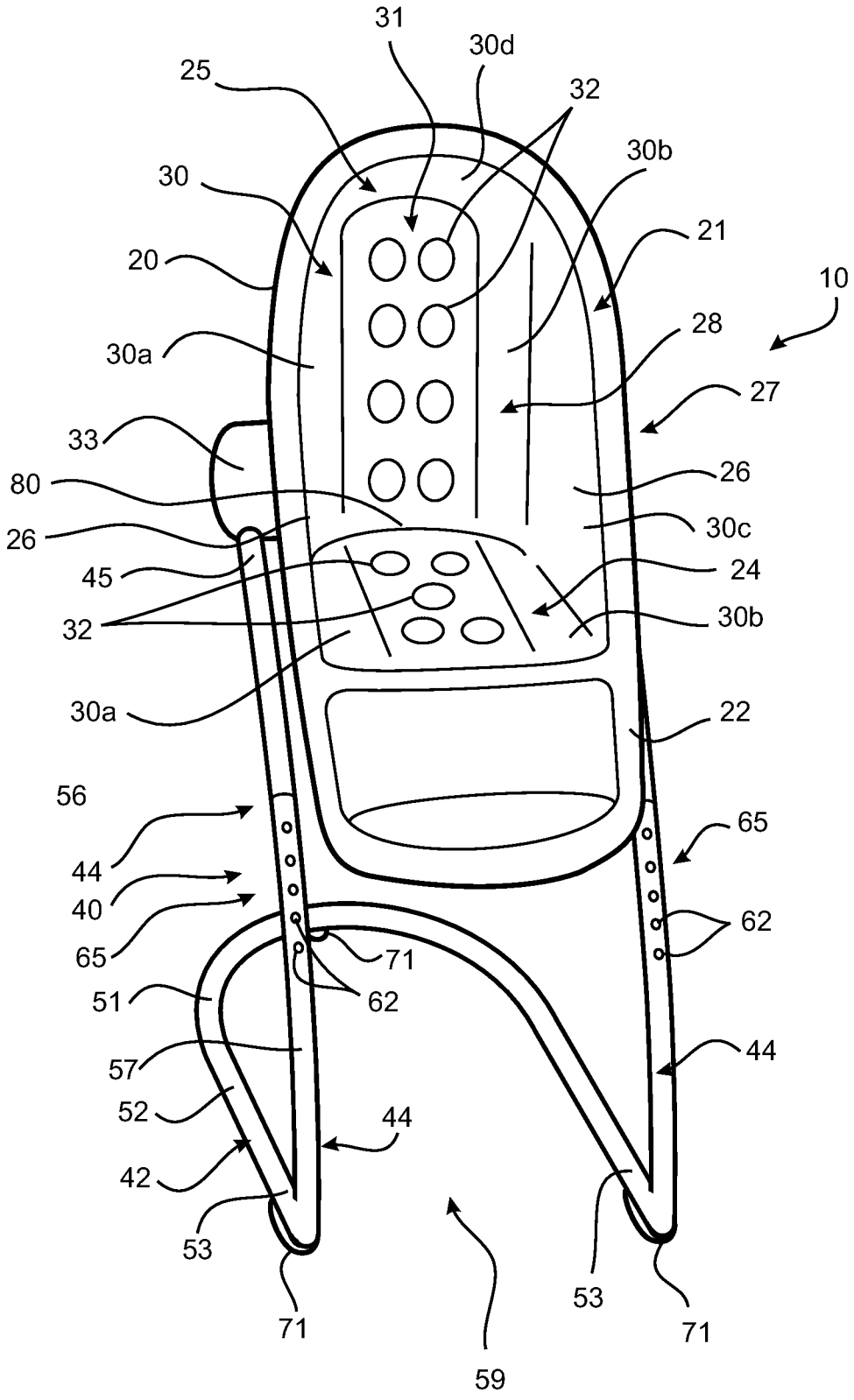
FIG. 1 is a front perspective view of the stand in accordance with a first embodiment of the best mode.

The best mode for carrying out the invention is described with respect to three specific embodiments, each being directed towards a bathing stand used for showering an object in the form of a child being an infant or toddler. In the description of these embodiments the same reference numerals are used for identifying the same or like components of the bathing stand.

Figure 2:
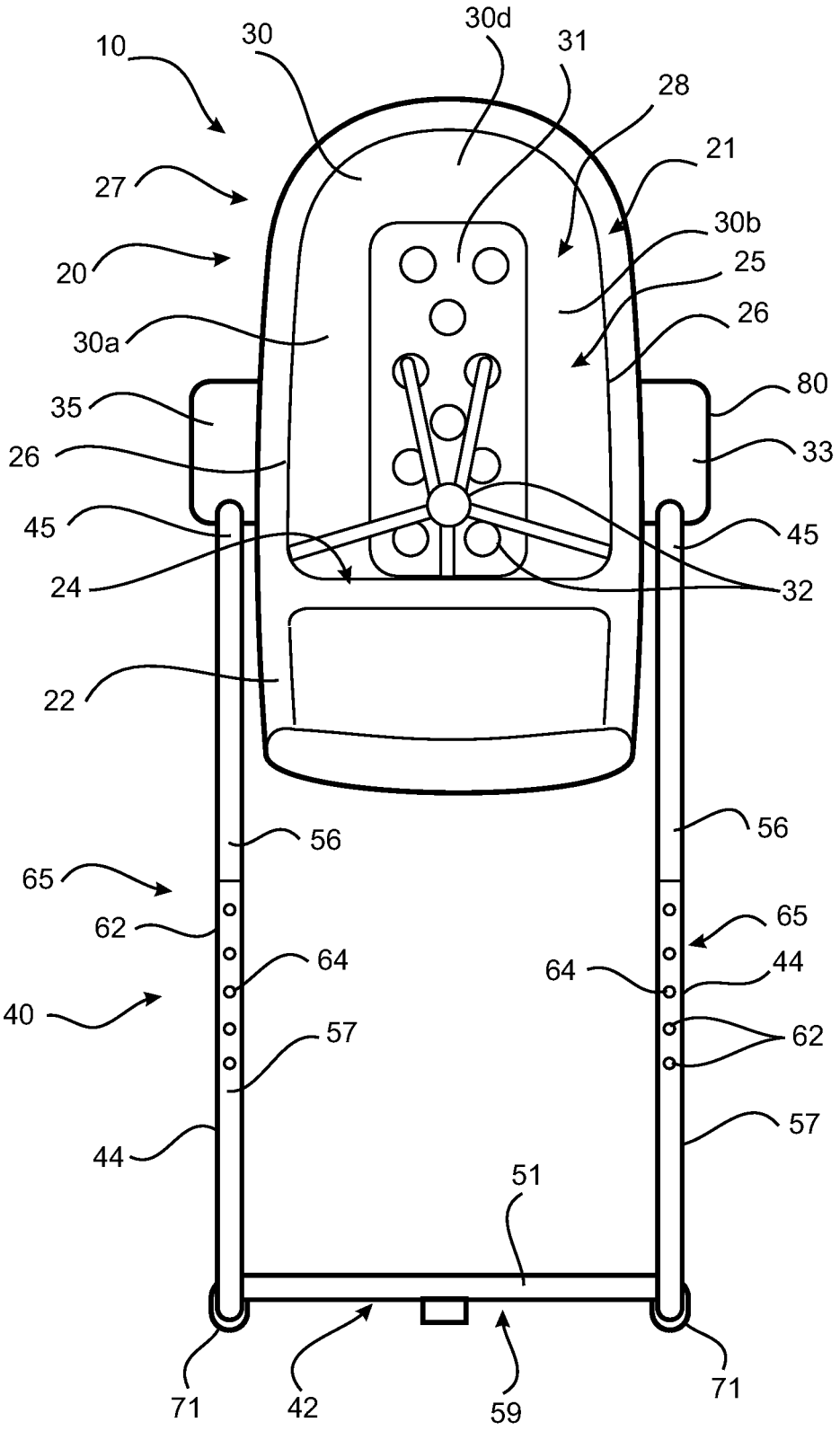
FIG. 2 is a front elevation of the stand shown in FIG. 1.
Figure 3:
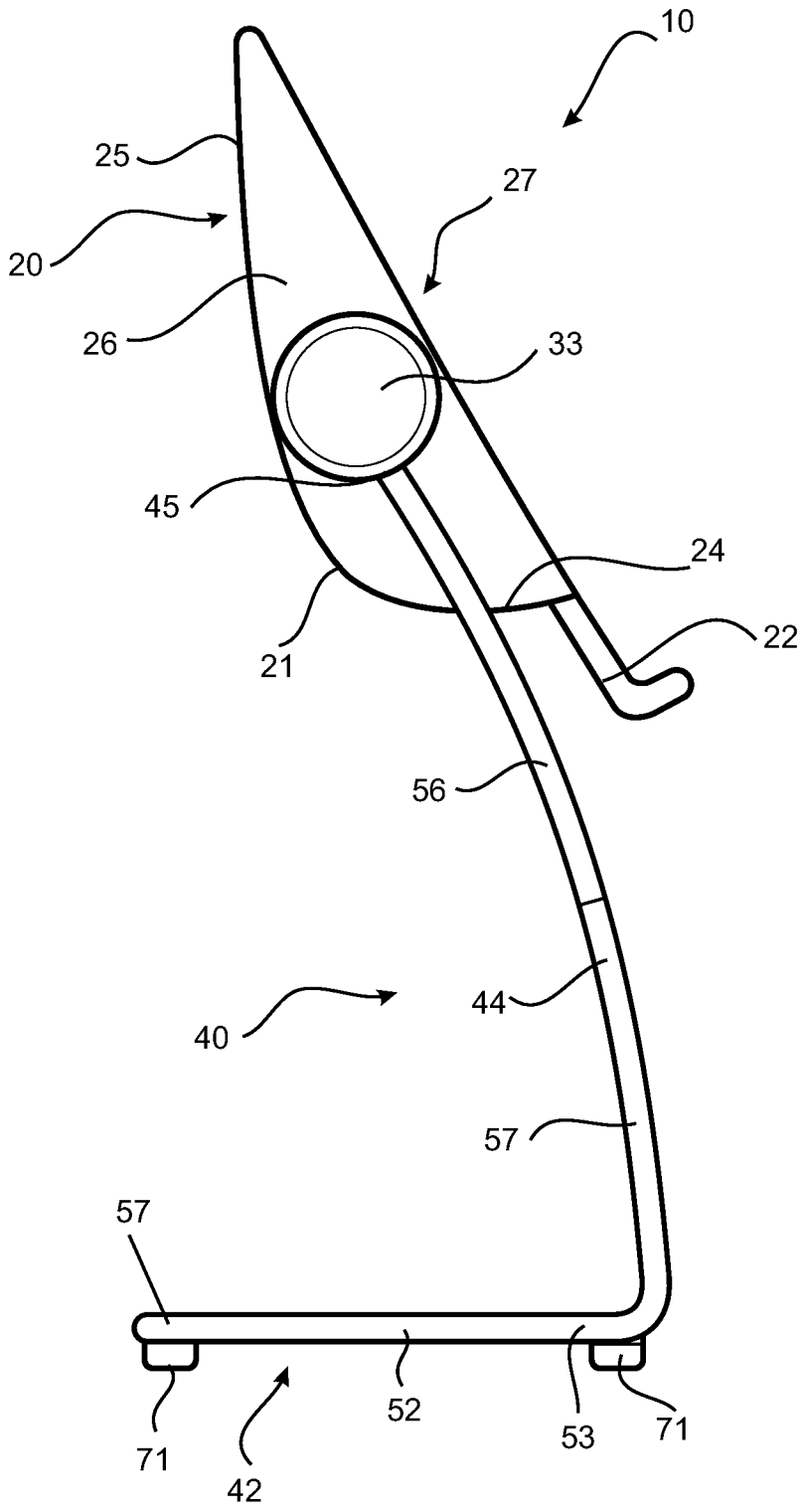
FIG. 3 is a side elevation of the stand shown in FIG. 1.

FIGS. 1 to 3 show a bathing stand in the form of a chair 10 for showering an infant or toddler in accordance with the first embodiment of the best mode. The chair 10 comprises a chair body 20 supported by a pedestal 40.

The chair body 20 comprises a shell 21 and a footrest 22. The shell 21 is generally formed as a capsule comprising a hollow pod and defines a seat 24, a seatback 25 and side guards 26. The seatback 25 is slightly curved and is generally perpendicular to the seat 24. The side guards 26 extend between the respective lateral edges of the seat 24 and the seatback 25.

The seat 24, seatback 25 and side guards 26 together define an open front 27 and an internal space 28 for receiving at least the torso and head portion of an infant or toddler in use.

The shell 21 comprises padding means 30, which comprises side portions 30*c* covering the internal surfaces of the side guards 26, lateral portions 30*a* and 30*b* which cover respective internal lateral sides of the seat 24 and the seatback 25, and a head portion 30*d* which covers the upper portion of the seatback 25.

The lateral portions 30*a* and 30*b* are separated by a middle section 31 therebetween. The middle section 31 is a portion of the shell 21 which is not padded, and which includes a plurality of spaced circular apertures 32. The shell 21 also includes harness means 80, such as a 5-point strap assembly for securing the torso of the infant or toddler within the internal space 28 in use. The footrest 22 extends from a lower portion of the shell 21.

The shell 21 in the embodiment is integrally made from a single piece of plastics material and the padding means 30 is made from a waterproof flexible material such as plastics, vinyl or leather which contains cushioning material therein.

The pedestal 40 is made of waterproof material such as aluminium or plastic coated metal and comprises a base 42 and lateral posts 44 which extend generally upwardly from the base 42. The base 42 is generally U-shaped and comprises a rear curved section 51 and two straight side sections 52 having a respective front end 53. The base 42 comprises wheels 71 disposed below the curved section 51 and the front ends 53. Each of the wheels 71 can be selectively locked as required to prevent movement of the chair 10 when required.

The lateral posts 44 extend from a respective front end 53 of the side sections 52. Each lateral post 44 is curved and extends upwardly and rearward, such that an upper end 45 thereof is disposed substantially vertically over the rear section 51. The chair body 20 is pivotally attached to the stand 40, by outer surfaces of the side guards 26 being pivotally attached to a respective upper end 45 of the lateral posts 44, with an angle adjustment means 33 provided therebetween which allows the angle of the chair body 20 relative to the ground to be adjusted and fixed at a desired angle. The angle adjustment means 33 can be any suitable means such as a biased pin on the chair body 20 which can engage a number of spaced holes in a plate attached to the upper end 45 of the lateral posts 44.

Each lateral post 44 comprises an upper portion 56 received in a lower portion 57 such that they are arranged telescopically with each other. Each lower portion 57 comprises a number of spaced holes 62 and each upper portion 56 comprises a biased lock pin 64 which can selectively engage one of the spaced holes 62 for adjusting the effective length of the lateral post 44. In this manner, a height adjustment means 65 is provided where the height of the chair body 20 from the ground can be adjusted as desired. The lateral posts 44 are of a length to allow the lowermost portion of the shell 21 from the ground to be adjusted up to a height of 2 metres. Preferably, the height adjustability is between 1 metre and 2 metres from the ground as required.

The shape of the pedestal 40 provides an open front 59 which allows an adult to stand between the lateral posts 44 so that the adult can stand close to the chair body 20 in use. Also, the base 42 is dimensioned to be small enough to fit inside a standard shower. The pedestal 40 is made from non-rusting material such as plastics or suitably coated metal material.

In use, an adult parent or carer will adjust the chair 10 as required prior to placing the infant/toddler therein. For example, the angle of the chair body 20 will be adjusted via the angle adjustment means 33 as infants will require a more laid back orientation than older toddlers. Also, the adult can adjust the height of the chair body 20 via the height adjustment means 65 so that the adult does not have to bend down unnecessarily during use.

The adult can then place the child in the chair body 20 and secure the child therein via the harness means 80. The adult then wheels the chair 10 into the shower and the infant/toddler can be washed. The middle section 31 which is not padded provides a channel which provides space for the adult's arm and hand for washing the back, bottom and back of leg portions of the infant/toddler while the toddler is secured in the chair body 20. Also, the shell 21 provides an open front 27 with no obstructions which provides the adult with easy access to the child. Water in the chair body 20 drains via the circular apertures 32 in use.

The first embodiment thus provides an infant/toddler shower chair which allows parents and carers to easily handle an infant/toddler in the shower. The adult can easily wheel in the infant/toddler in the chair and with ease shower the infant/toddler without hurting their back and with the infant safely secured within the chair. The infant/toddler is provided with cushioned seating and the chair can be used in all seasons.

Whilst the first embodiment of the present invention has been described with several features, it will be apparent to skilled persons that modifications can be made to the particular embodiment described. For example, the pedestal can be embodied in other forms, such as a tripod form. Also, the footrest can be made to be adjustable in length and the shell can be provided with means for attachment of infant/toddler toys for the child in use.

Also, it is possible to vary the shape of the padding means, such as by having the middle unpadded section to be in the shape of an X. The chair body can also be made removable and reattachable to the pedestal. The pedestal can also be made foldable such that at least the base portion thereof can be reduced in width. These features will assist in use of the chair through narrow shower screen doors or storage of the chair.

Figure 4:
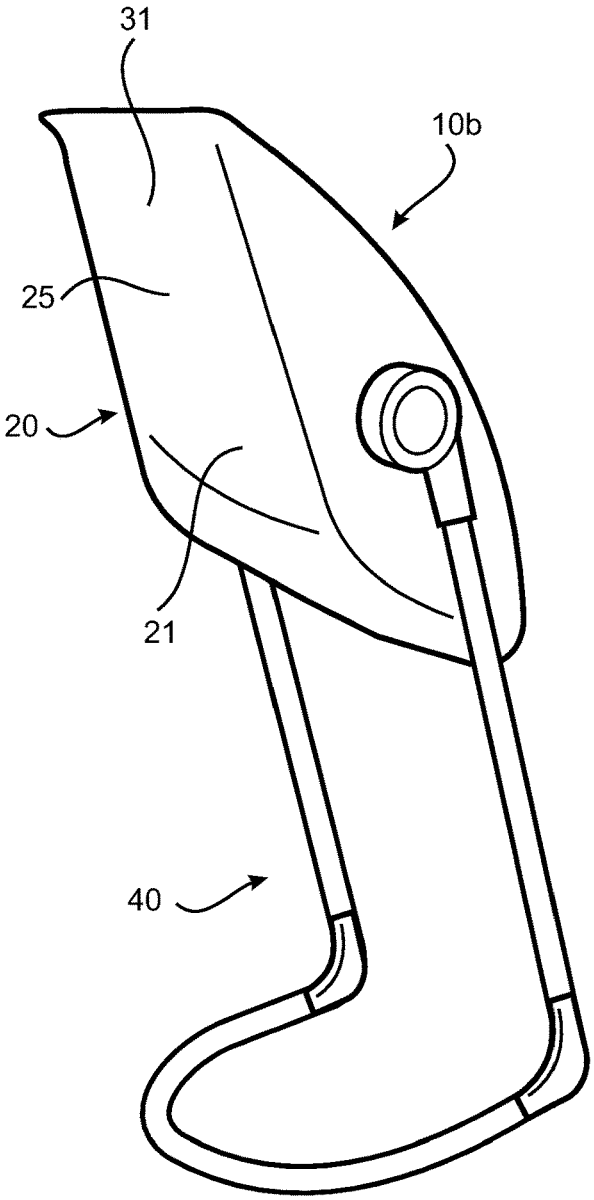
FIG. 4 (*a*) is a rear perspective view of the stand in accordance with a second embodiment of the best mode.
Figure 4:
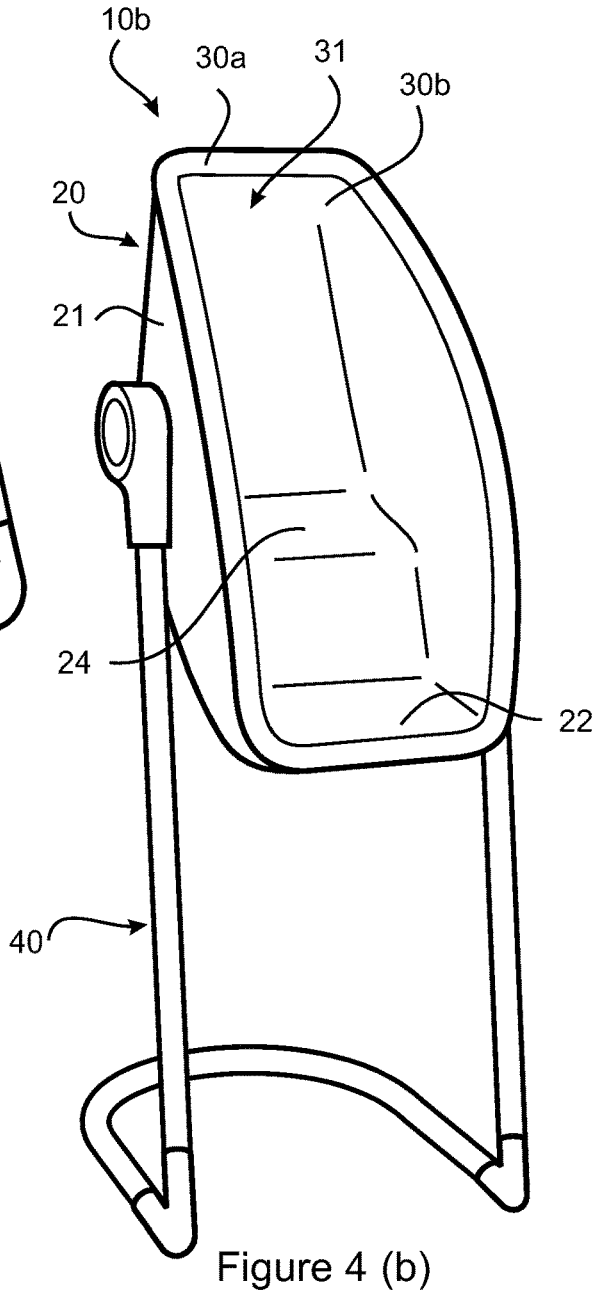
Figure 5:
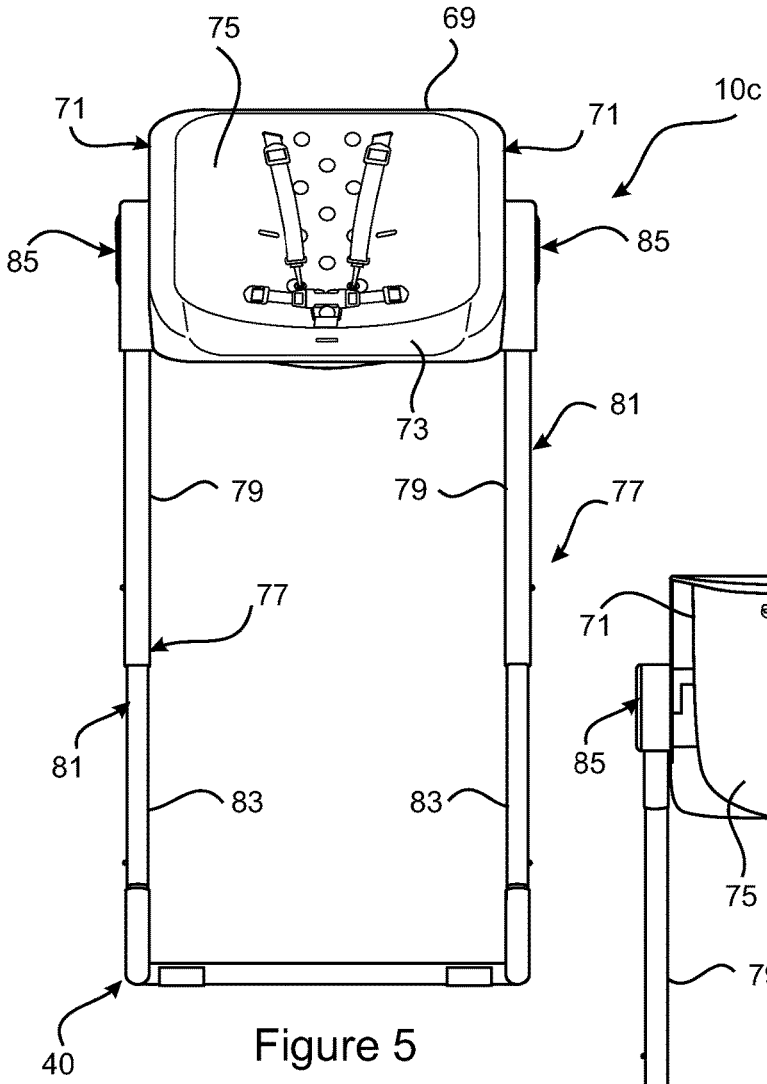
FIG. 5 is a front elevation of the stand in accordance a third embodiment of the best mode.
Figure 6:
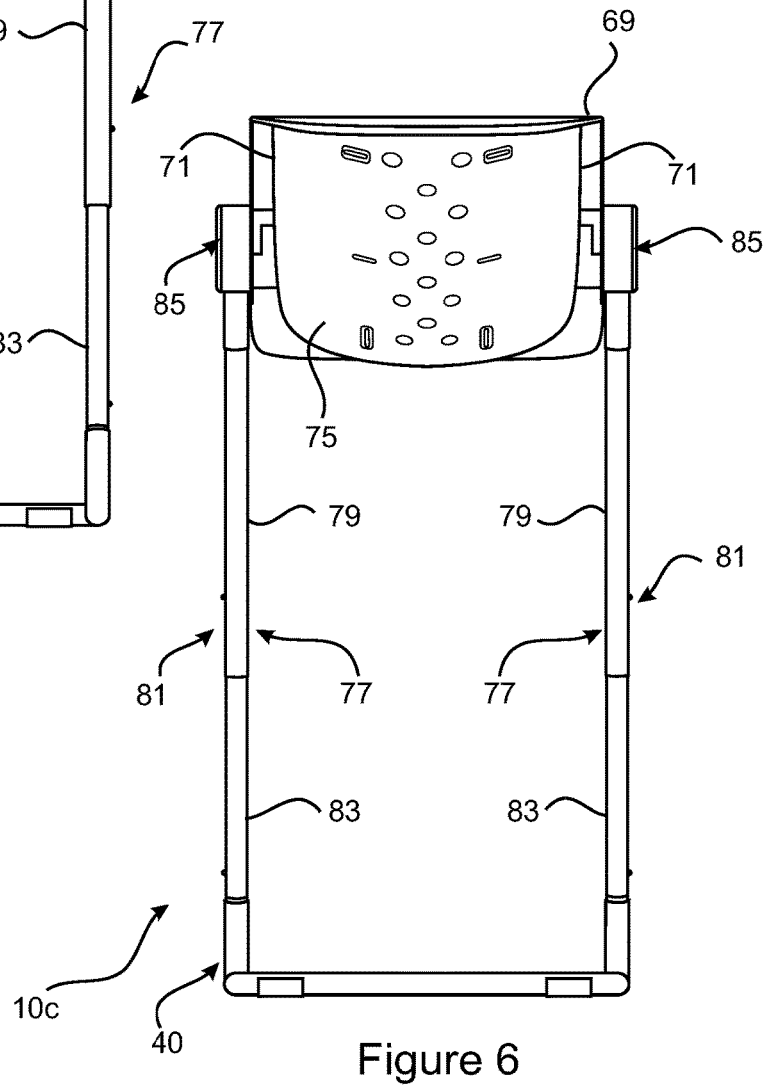
FIG. 6 is a rear elevation of the stand shown in FIG. 5.
Figure 7:
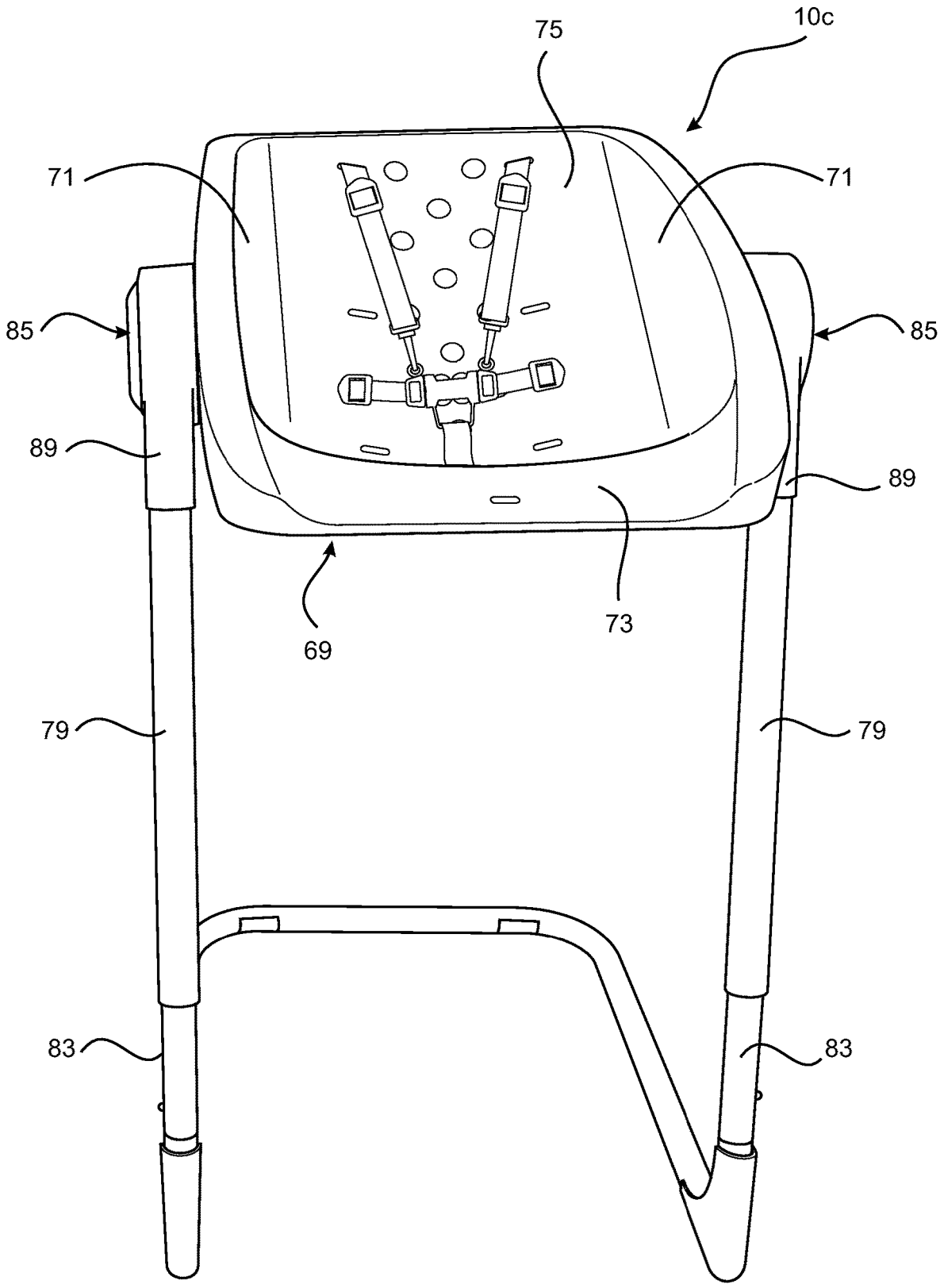
FIG. 7 is a close-up front perspective view of the stand shown in FIG. 5.
Figure 8:
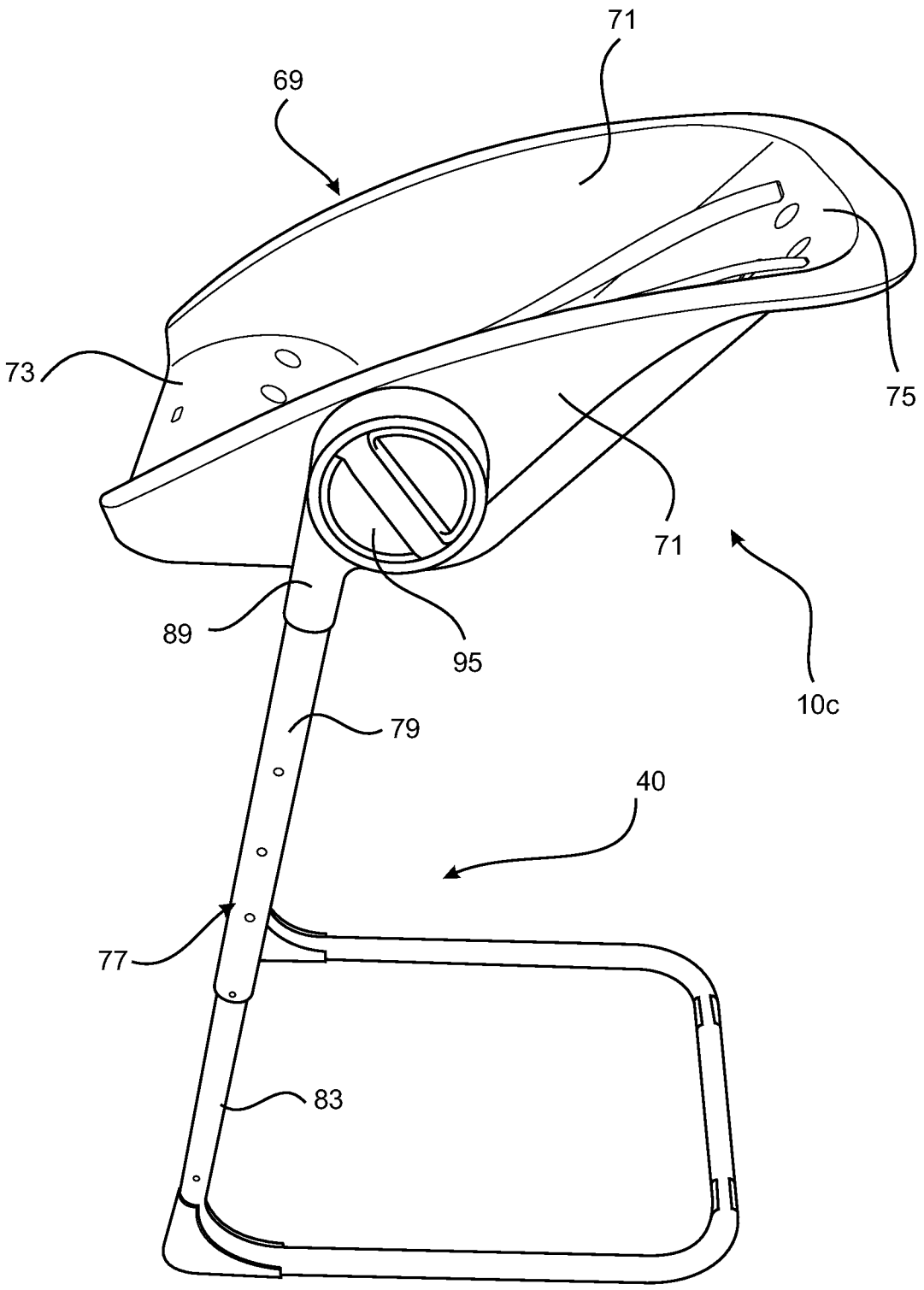
FIG. 8 is an upper perspective side elevation of the stand shown in FIG. 5.
Figure 9:
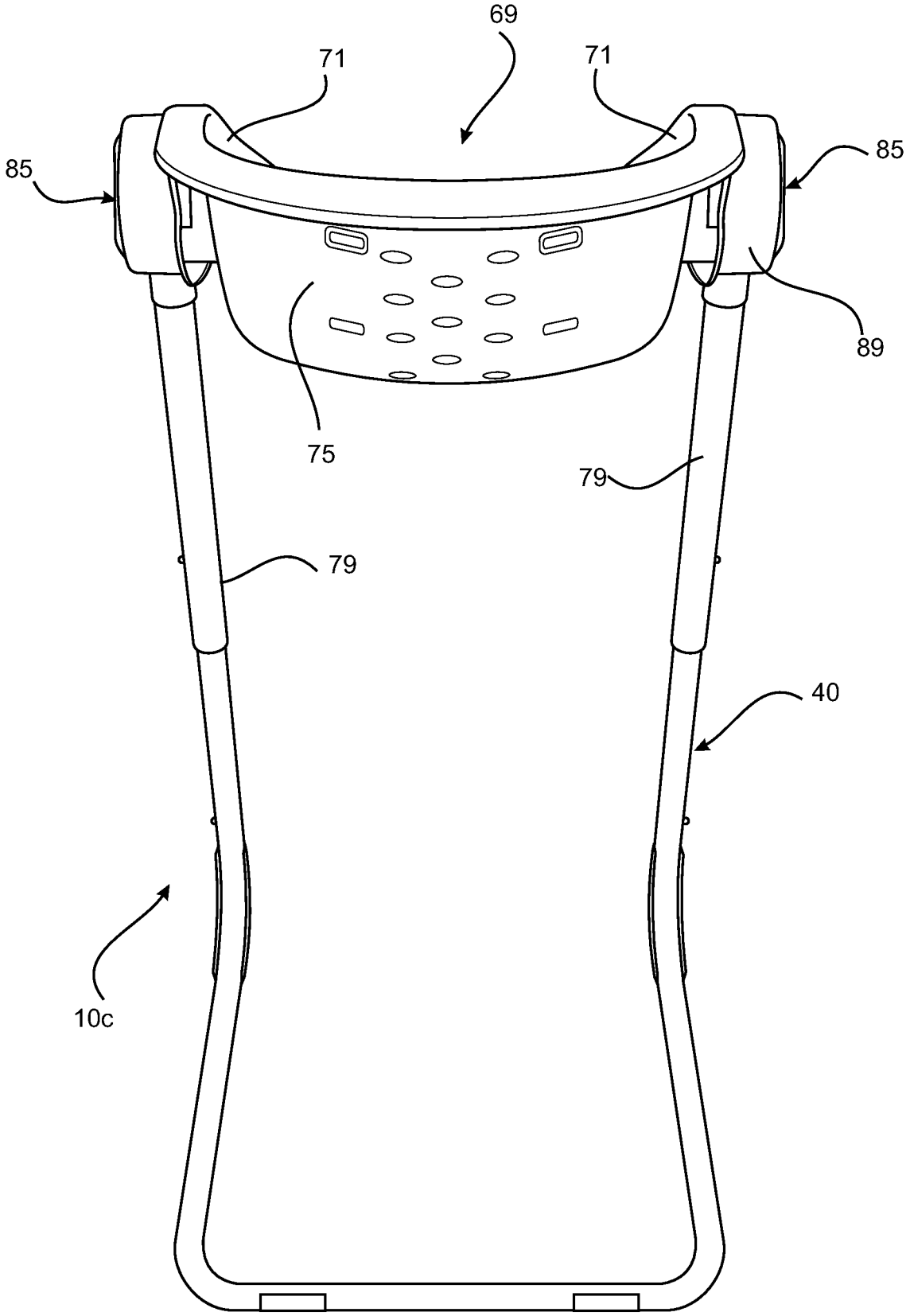
FIG. 9 is an upper perspective rear elevation of the stand shown in FIG. 5.
Figure 10:
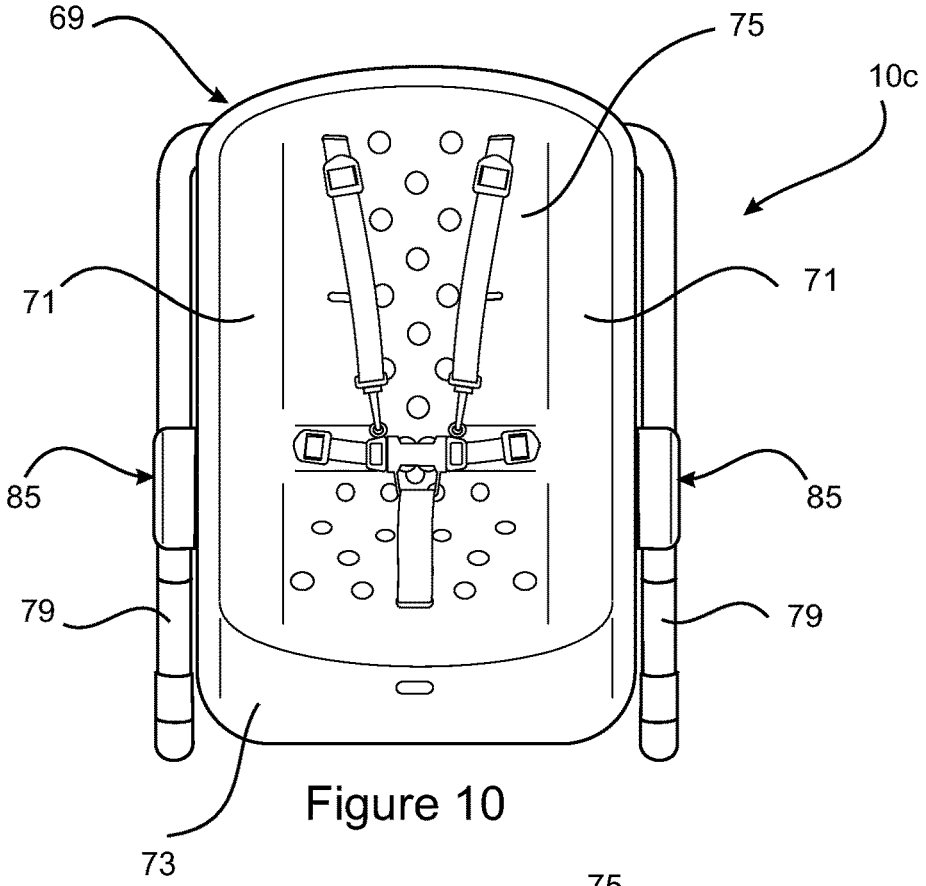
FIG. 10 is an upper plan view of the stand shown in FIG. 5.
Figure 11:
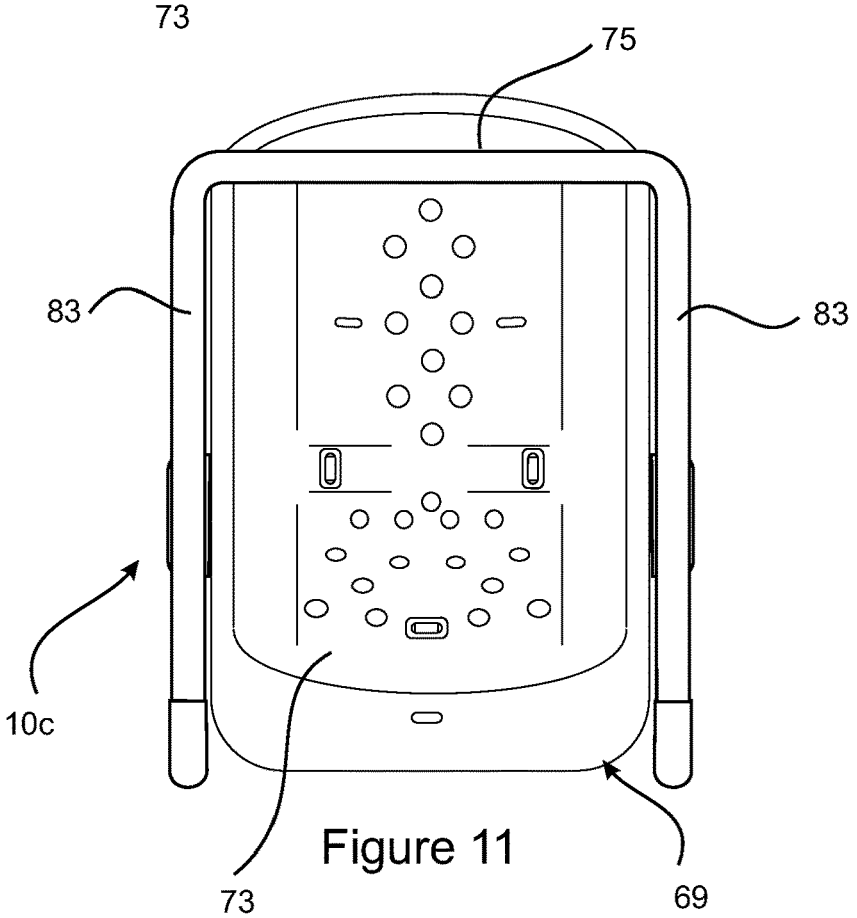
FIG. 11 is an underside plan view of the stand shown in FIG. 5.
Figure 12:
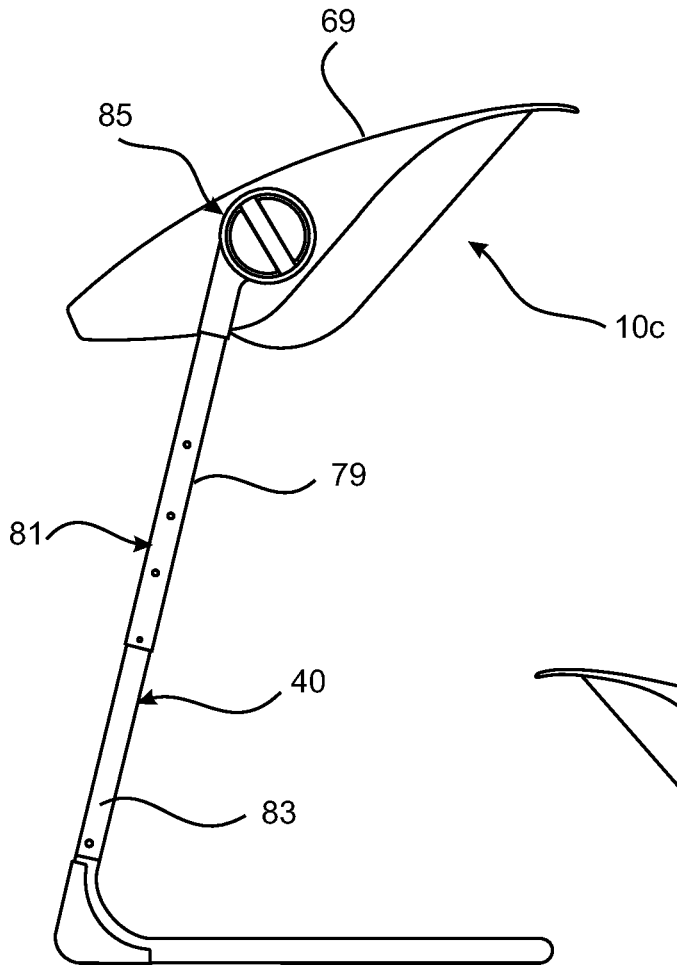
FIG. 12 is a side elevation of the stand shown in FIG. 5 as seen from one side.
Figure 13:
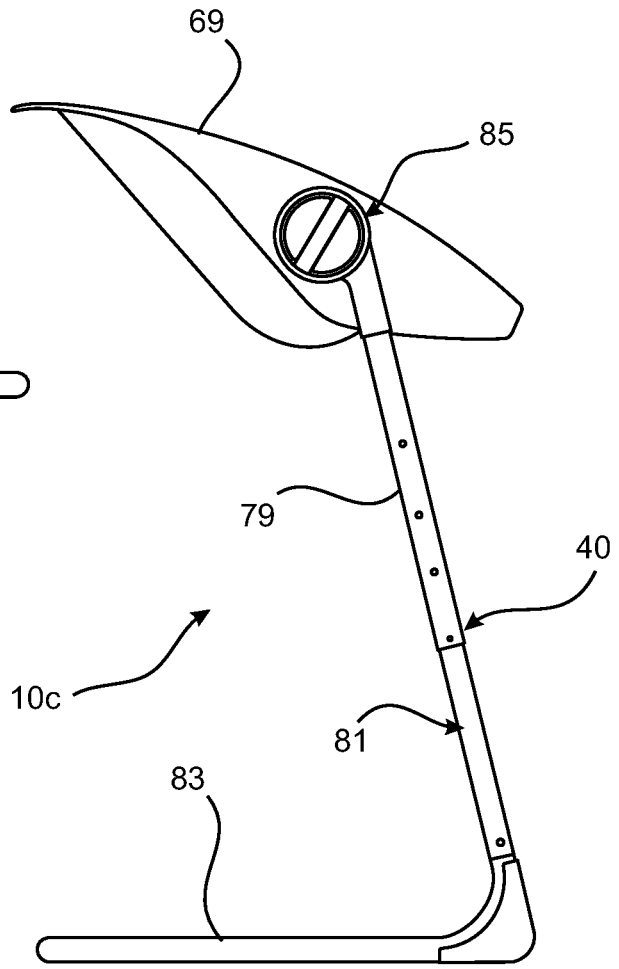
FIG. 13 is an opposite side elevation of the stand shown in FIG. 12.

The second embodiment is a simpler and more refined form of the stand described in the first embodiment and is shown in FIG. 4 of the drawings.

The stand comprises a modified chair 10*b*, which is similar to the chair 10 of the first embodiment. The chair 10*b* similarly comprises a chair body 20 supported by a pedestal 40.

In this embodiment however, the shell 21 does not comprise padding means. Instead, lateral portions 30*a* and 30*b* of the seatback 25 are separated by a middle channel section 31 therebetween, which is integrated into the seatback. The middle channel section 31 thus forms the seatback and is not discrete to it.

The other features of the chair 10*b* are similar to that of the chair 10, including having a harness means 80 and the features of the pedestal 40. However, in the present embodiment, the footrest 22 is incorporated into the design of the capsule, rather than as being an extension of the capsule as in the first embodiment.

The chair body 10*b* thus still has one section comprising portions separated by a channel section 31 sized to receive at least a user's hand or arm, but constitutes the seatback itself.

The chair 10*b* also comprises a number of spaced apertures therein, preferably in the channel section 31.

In the present embodiment the lateral portions 31*a* and 30*b* also dispense with the padding means.

The chair 10*b* comprises a height adjustment means where the height of the lowermost portion of the chair body from the ground can be adjusted up to a height of 2 metres.

The height adjustment means allows the height of the lowermost portion of the chair body from the ground to be adjusted between heights of 70 cm to 2 metres.

The chair body 20 is similarly pivotally attached to the pedestal 40, which allows the angle of the chair body relative to the ground to be adjusted and fixed at a desired angle.

The chair 10*b* also includes an angle adjustment means between the chair and the stand.

The channel section 31 extends from an upper portion of the chair body 20 all of the way to the footrest.

The third embodiment is directed towards a further refinement of the stand of the preceding embodiments, where the seatback is wider and the capsule shallower to enable easier bathing of the child. The adjustment means mechanism is of an alternative and improved design, including a rotation limiting means to restrict rotation of the seat relative to the pedestal between a prescribed range of angular movement.

As shown in FIGS. 5 to 19, the stand comprises a chair body 10*c* forming a shallow capsule defining a seat 69 having sides 71, a seat base 73 and a seatback 75. The seat base 73 and the seatback 75 are integrated and combine with the sides 71 to encapsulate the torso of the child.

The pedestal 40 is still of tubular design made of waterproof material, but is of slightly different configuration to that of the preceding embodiments. Height adjustment means 77 of the pedestal 40 is still provided by the upper seat attachment portions 79 of the lateral posts 81 forming an outer sleeve over the lower ground engaging portions 83, where retractable locking pins can be manually operated to fix the height adjustment of the pedestal.

Figure 14A:
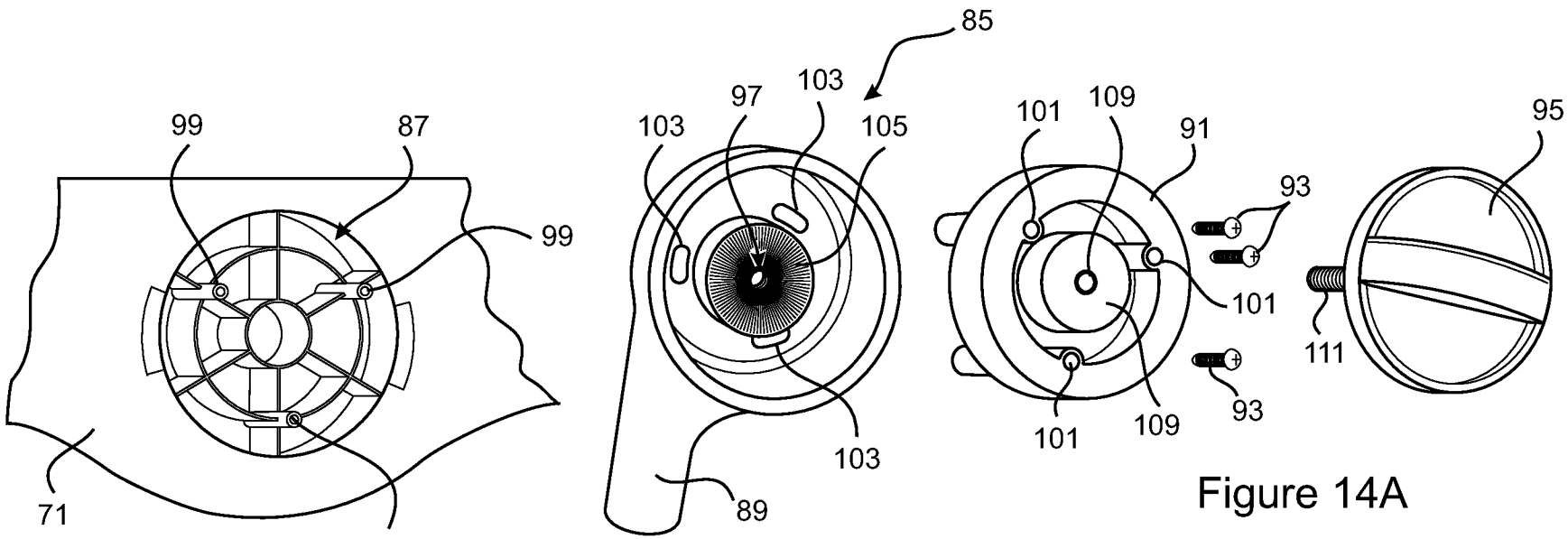
FIG. 14A is an exploded view of the components constituting the adjustment means mechanism in accordance with the third embodiment.
Figure 14B:
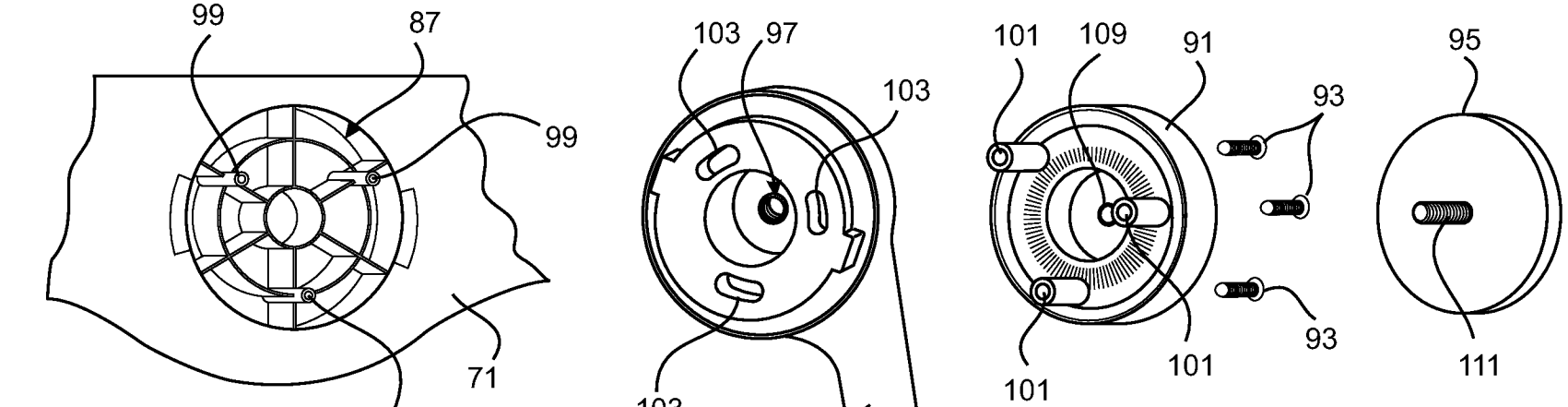
FIG. 14B is a reverse view of components shown in FIG. 14A to be fitted to the moulded seat recess.

As best shown in FIGS. 14 and 15, the adjustment means mechanism 85 comprises a number of components fitted together to selectively support and angularly locate the seat 69 relative to the pedestal 40. These components include a pair of seat recesses 87 that are moulded one into each of the outer sides of the seat 69, a pair of stand seat supports 89, one fitted respectively to the seat connecting ends of the upper seat attachment portions 79, a pair of adjustment latches 91 each fitted into a corresponding stand seat support 89 and secured to the corresponding seat recess 87 by means of latching screws 93, and a pair of locking spindles 95, each screwed into a corresponding threaded sleeve 97 provided in each stand seat support 89.

Figure 15A:
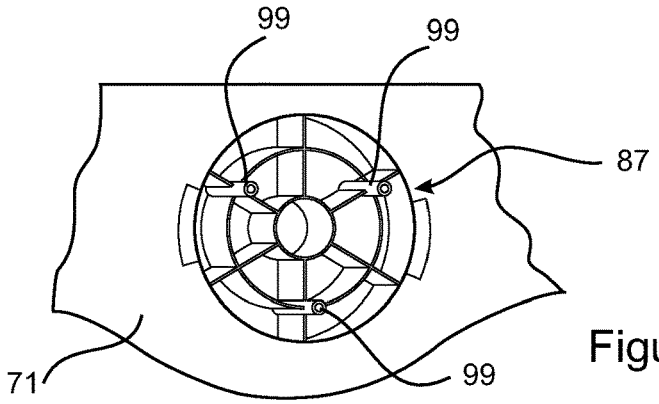
Figure 15B:
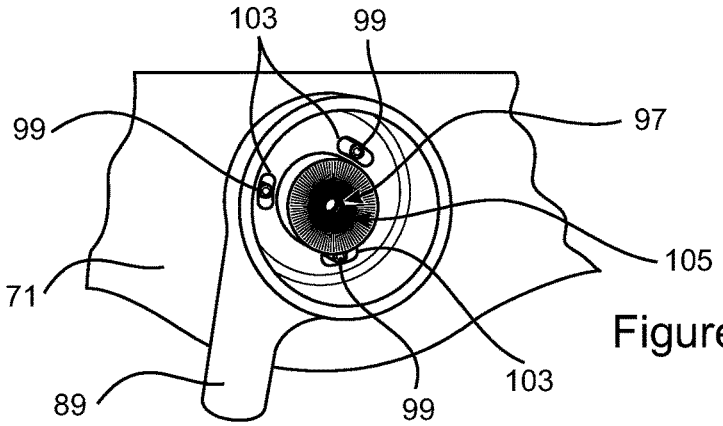
Figure 15C:
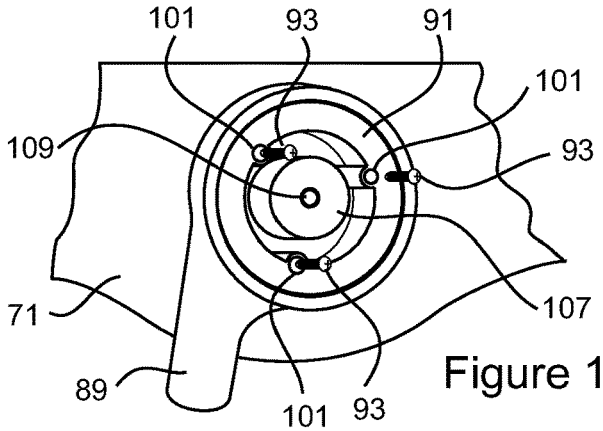
Figure 15D:
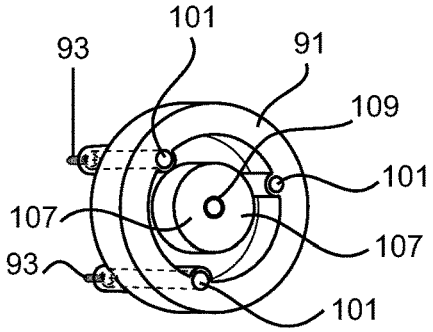
Figure 15E:
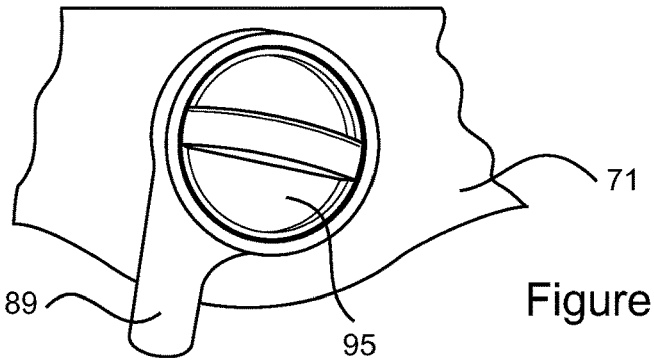

As shown in FIGS. 15A, 15C and 15D, each seat recess 87 is formed with three threaded spigots 99, which are equidistantly disposed to align with three recesses 101 integrally formed within each of the adjustment latches 91 to fixedly receive the latching screws 93.

The stand seat supports 89 are each formed with three transversely extending slots 103 are similarly equidistantly disposed to align with and accommodate the three threaded spigots 99 therein to form the rotation limiting means. Moreover, the three threaded spigots can move transversely to a limited degree within the angular extent of each slot 103, allowing the seat 69 to angularly rotate relative to each stand seat support 89.

Figure 16:
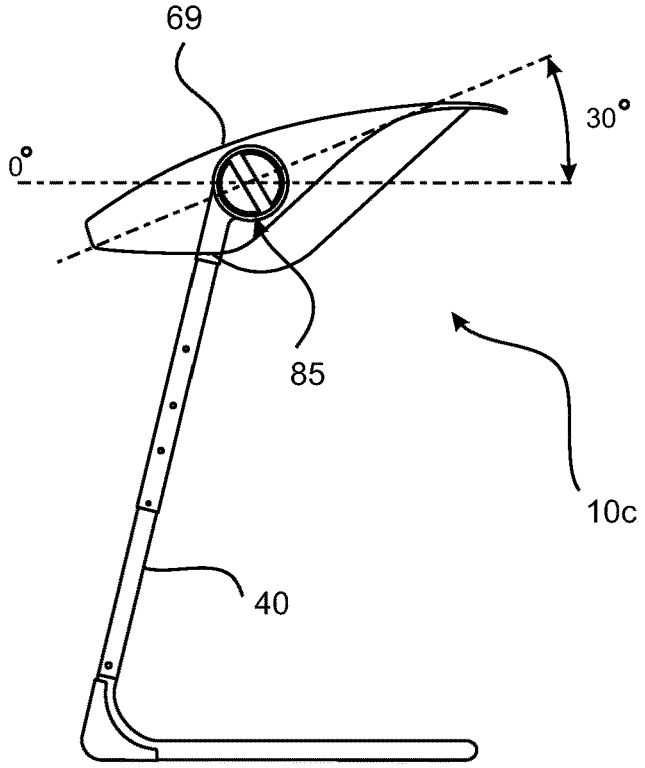
FIG. 16 is a side elevation showing the seat positioned in its maximally reclined attitude relative to the pedestal of the stand shown in FIG. 5.
Figure 17:
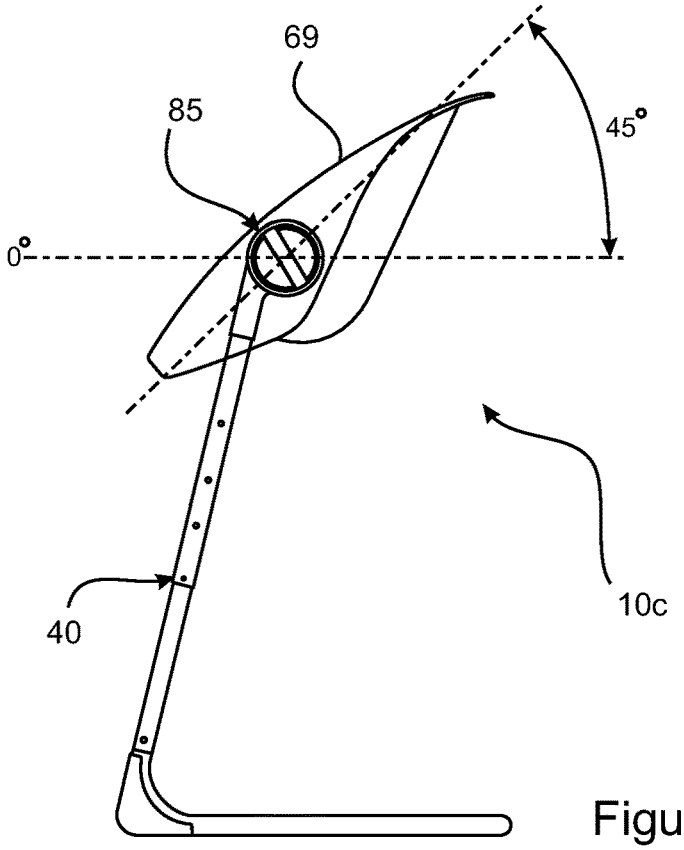
FIG. 17 is a similar side elevation to that of FIG. 16 showing the seat positioned in its most vertical attitude relative to the pedestal.

The range of movement is limited to approximately 15°, as shown in FIGS. 16 and 17, whereby at one extreme as shown in FIG. 16, the seat 69 is positioned at a maximally reclined attitude of approximately 30° relative to the horizontal, and at another extreme as shown in FIG. 17, the seat is positioned at its most vertical attitude relative to the pedestal, being at an angle of approximately 45° to the horizontal.

The stand seat supports 89 each comprise a central circular upstanding boss 105 having a knurled outer surface and centrally within each is disposed the corresponding threaded sleeve 97.

The adjustment latches 91 are of complementary circular shape to the inner recesses provided by the stand seat supports 89 and have a complementary shaped circular recess on the inner side to receive and accommodate relative rotation of the corresponding circular upstanding boss 105 therein. The outer side of each adjustment latch 91 correspondingly forms an outward extending boss 107 having a central aperture 109 to align with the threaded sleeve 97 of the corresponding stand seat support 89.

The locking spindles 95 each have a threaded shaft 111 that can be disposed within the aperture 109 of the corresponding adjustment latch 91 and which are of a diameter to threadedly engage the threaded sleeve 97 formed within the upstanding boss 105 of each stand seat support 89. By consequential rotation of each locking spindle 95, the inner surface presses upon the outer surface of the corresponding adjustment latch 91 and clamps it to the inner recess provided by the corresponding stand seat support 89, resulting in the knurled outer surface of the circular upstanding boss thereof frictionally engaging the confronting inner surface of the complementary shaped circular recess of the adjustment latch 91 and locking the angular position of the corresponding seat recess 87 relative to the corresponding stand seat support 89.

Figure 18:
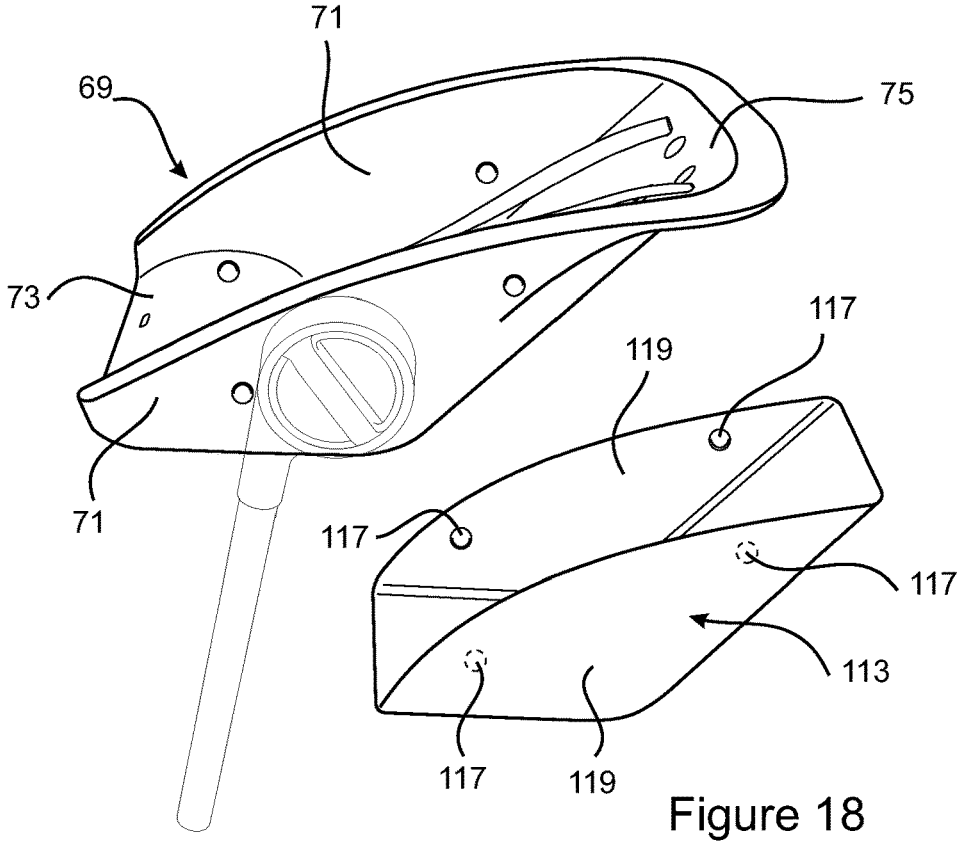
FIG. 18 is a pair of schematic side perspective views showing a bath shell accessory being fixedly located to the rear of the seat of the stand in accordance with the third embodiment.
Figure 19:
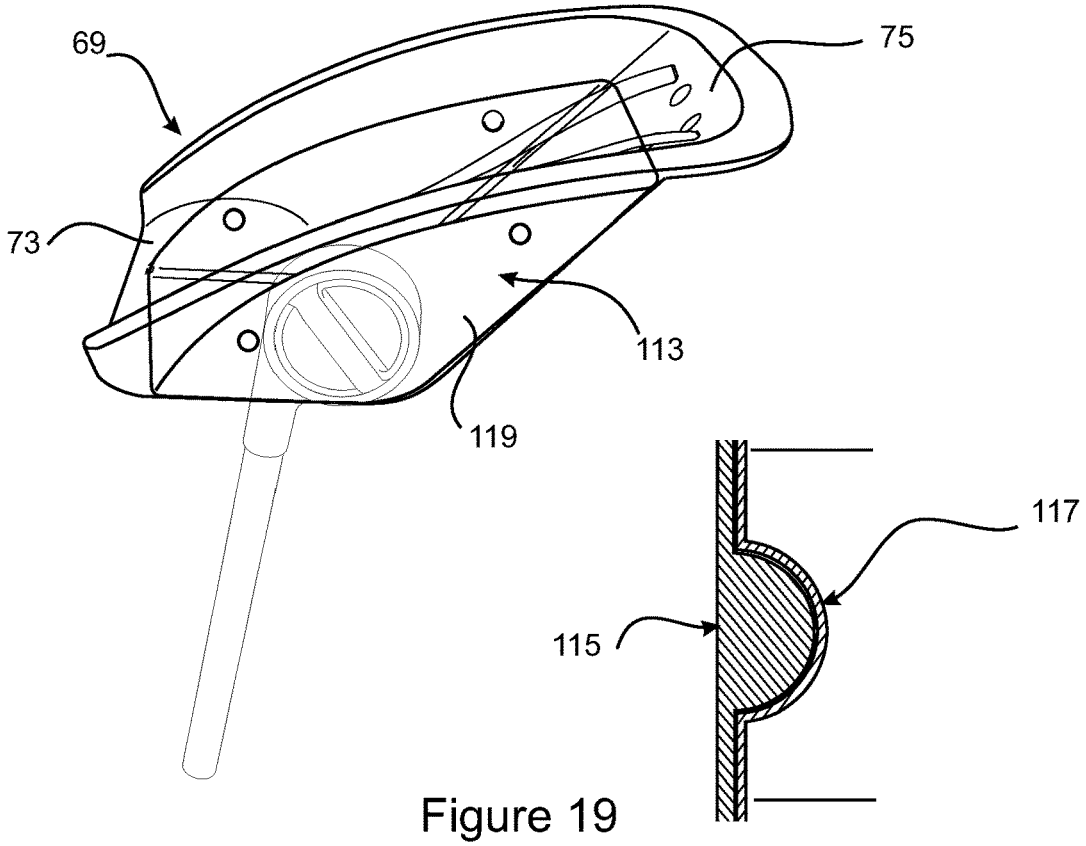
FIG. 19 is a fragmentary cross-sectional view showing fixing lugs disposed to facilitate the fixing of the bath shell accessory to the seat rear as shown in FIG. 18.
Figure 20:
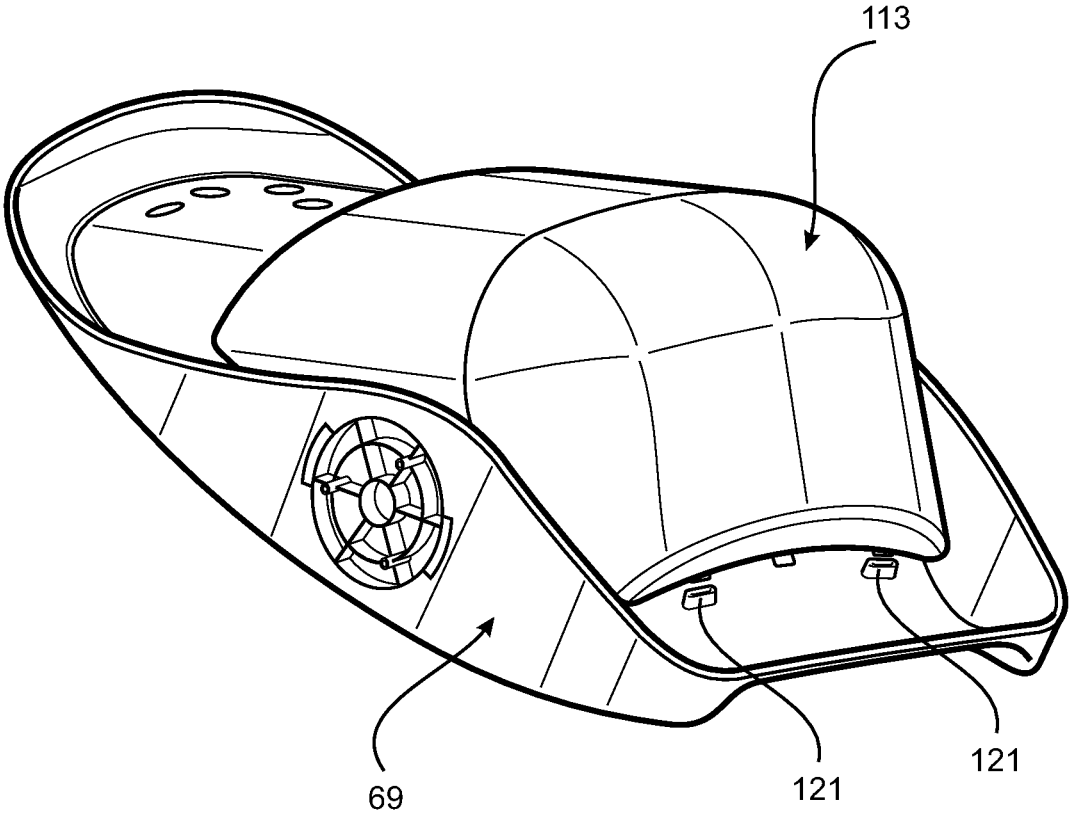
FIG. 20 is a rendered rear perspective view showing the bath shell accessory fixedly located to the rear of the seat shown in FIG. 18, with the lower locating clips for facilitating the fixing of the bath shell accessory to the seat rear.

The rear of the seat 69 is also particularly formed to positively receive and fix into position a bath shell accessory 113, as shown in FIG. 18. The bath shell accessory 113 is shaped to closely fit the rear surface of the seat 69 and be clipped into position by a series of fixing lugs 115 integrally moulded into the rear of the seat and correspondingly disposed for alignment with accommodating recesses 117, similarly moulded integral into the bath shell accessory. As shown in the drawings, four such fixing lugs 115 and recesses 117 are provided along the sides of the seat and the sidewalls 119 of the accessory 113.

To help maintain the bath shell accessory 113 in fixed position to the rear of the seat 69, a pair of lower clips 121 and opposing upper clips (not shown) are formed in the rear seat to engage and clip the lower and upper edges of the bath shell accessory in position.

The bath shell accessory 113 forms a V-shaped trough, which when the seat 69 is disposed in the maximally reclined position as shown in FIG. 16 provides a well within which water may pool at the juncture between the seat base 73 and the seatback 75.

In certain embodiments, the bath shell accessory 113 can be provided with sealing means around its periphery to help sealingly engage with the rear of the seat, or alternatively the apertures within the seat may be occluded to allow water to pool within the juncture between the seat base 73 and the seatback 75

While there have been described a plurality of embodiments of the invention, those skilled in the art will recognize that other and further modifications may be made thereto without departing from the spirit of the invention. It is intended to claim all such changes and modifications that fall within the scope of the invention.

What is claimed is:

1. A child bathing stand or chair for supporting a child, the child bathing stand or chair including:

a seat to support a torso of the child, the seat comprising a shell forming a hollow pod having sides defining side guards, a seat base and a seatback; and a pedestal upon which the seat is mounted in an elevated position;

wherein the seat base comprises internally extending lateral sides devoid of apertures and a centrally disposed expansive and planar middle section having a plurality of spaced apertures disposed therein, and a relative arrangement of the lateral sides and middle section, in combination with a disposition of the apertures, facilitates continuous channeling of water to the middle section for drainage from the seat base when in use with a child seated within the seat; and further comprising an adjustment means mechanism operationally engaged between the seat and the pedestal and adapted to selectably permit the seat to rotate with respect to the pedestal the adjustment means mechanism having a seat recess molded into the seat, a stand seat support engaged with the pedestal, and selectably rotatable with respect to the seat recess, the seat stand support comprising a circular upstanding boss defining a outer knurled surface, an adjustment latch fixedly engaged to the seat recess and comprising a confronting inner surface selectably movable with respect to the outer knurled surface, and a locking spindle comprising a threaded shaft rotatable to selectably frictionally engage the confronting inner surface to the outer knurled surface.

2. A child bathing chair comprising:

a seat supported by a pedestal, the seat comprising an integrally formed shell shaped as a hollow pod including: (i) a seat base and seatback adapted to support at least a torso of a child; and (ii) side guards extending between respective lateral edges of the seat base and the seatback; and the seat base having internally extending lateral sides devoid of apertures and a centrally disposed and planar middle section;

wherein the middle section includes a plurality of spaced apertures in the seat base so that a relative arrangement of the lateral sides and middle section, in combination with a disposition of the apertures, facilitates continuous channeling of water to the middle section to drain water from the seat base when in use with a child seated within the seat; and further comprising an adjustment means mechanism operationally engaged between the seat and the pedestal and adapted to selectably permit the seat to rotate with respect to the pedestal, the adjustment means mechanism having a seat recess molded into the seat, a stand seat support engaged with the pedestal, and selectably rotatable with respect to the seat recess, the seat stand support comprising a circular upstanding boss defining a outer knurled surface, an adjustment latch fixedly engaged to the seat recess and comprising a confronting inner surface selectably movable with respect to the outer knurled surface, and a locking spindle comprising a threaded shaft rotatable to selectably frictionally engage the confronting inner surface to the outer knurled surface.

3. A child bathing chair comprising:

a seat supported by a pedestal, the seat comprising an integrally formed shell shaped as a hollow pod including: (i) a seat base and seatback adapted to support at least a torso of a child; and (ii) side guards extending between respective lateral edges of the seat base and the seatback;

the seat base having internally extending lateral sides and a centrally disposed and planar middle section, including a plurality of spaced apertures in the seat base;

a bath shell of complementary shape to a rear surface of the seat around a juncture between the seat base and the seatback, thereby forming a v-shaped trough to fit and be fixed into juxtaposition with the rear surface of the seat allowing water to pool in the bath shell and the seat at the juncture between the seat base and the seatback when the seat is in a reclined position; and further comprising an adjustment means mechanism operationally engaged between the seat and the pedestal and adapted to selectably permit the seat to rotate with respect to the pedestal, the adjustment means mechanism having a seat recess molded into the seat, a stand seat support engaged with the pedestal, and selectably rotatable with respect to the seat recess, the seat stand support comprising a circular upstanding boss defining a outer knurled surface, an adjustment latch fixedly engaged to the seat recess and comprising a confronting inner surface selectably movable with respect to the outer knurled surface, and a locking spindle comprising a threaded shaft rotatable to selectably frictionally engage the confronting inner surface to the outer knurled surface.

4. The child bathing chair as claimed in claim 3, wherein the pedestal comprises a base and lateral posts which extend upwardly from the base, whereby a length of the lateral posts can be adjusted;

the base being U-shaped and comprising a rear curved section and two straight side sections having a respective front end, whereby the lateral posts respectively extend from the front end; and the lateral posts are curved and extend upwardly and rearwardly;

wherein the pedestal is foldable such that at least the base thereof can be reduced in width;

and wherein each lateral post comprises an upper portion and a lower portion telescopically arranged with each other;

each lower portion comprising a number of spaced holes and each upper portion comprising a biased lock pin which can selectively engage one of the spaced holes for adjusting the effective length of the lateral post.

5. The child bathing chair as claimed in claim 3, wherein the fixing of the bath shell onto the rear surface of the seat is by detachably clipping the bath shell into position using a series of fixing lugs and receiving recesses, and wherein the fixing lugs are integrally moulded into the rear surface of the seat and the receiving recesses are correspondingly aligned and disposed on an inner surface of the bath shell.

* * * * *